US010710135B2

(12) United States Patent
Bergman et al.

(10) Patent No.: US 10,710,135 B2
(45) Date of Patent: Jul. 14, 2020

(54) DUAL-STAGE MULTI-ROLL LEVELER AND WORK ROLL ASSEMBLY

(71) Applicant: Machine Concepts, Inc., Minster, OH (US)

(72) Inventors: Guil Bergman, Ft. Recovery, OH (US); Chris Heid, Minster, OH (US); Lee Heitkamp, Maria Stein, OH (US); Tony Enneking, Minster, OH (US)

(73) Assignee: Machine Concepts Inc., Minster, OH (US)

( * ) Notice: Subject to any disclaimer, the term of this patent is extended or adjusted under 35 U.S.C. 154(b) by 530 days.

(21) Appl. No.: 15/387,274

(22) Filed: Dec. 21, 2016

(65) Prior Publication Data

US 2018/0169726 A1 Jun. 21, 2018

(51) Int. Cl.
*B21D 1/02* (2006.01)

(52) U.S. Cl.
CPC ..... *B21D 1/02* (2013.01)

(58) Field of Classification Search
CPC ..... B21D 1/02; B21D 3/02; B21D 1/06
See application file for complete search history.

(56) References Cited

U.S. PATENT DOCUMENTS 2,949,147 A 8/1960 Maust
3,301,031 A 1/1967 Bearer
3,416,340 A 12/1968 Ressor
3,581,536 A 6/1971 Terwillinger
3,596,489 A 8/1971 Ball
3,701,274 A 10/1972 Roesch
3,875,776 A 4/1975 Morooka
3,902,345 A 9/1975 Shida
4,116,029 A 9/1978 Fabian et al.
4,380,921 A 4/1983 Matsui
4,454,738 A 6/1984 Buta
4,633,693 A 1/1987 Tahara et al.
4,635,458 A 1/1987 Bradlee
4,651,549 A 3/1987 Masui
(Continued)

OTHER PUBLICATIONS

Gretchen Salois, Technology produces flat material by overcoming defects, Jan. 2013 ModernMetals Magazine p. 2 and 4, Jan. 2013.
(Continued)

*Primary Examiner* — Teresa M Ekiert
(74) *Attorney, Agent, or Firm* — Standley Law Group LLP; Eric M. Gayan; Adam J. Smith

(57) ABSTRACT

A dual-stage multi-roll leveler and an associated dual-stage work roll assembly. The dual-stage work roll assembly includes independent sets of first stage work rolls and second stage work rolls, with each set of work rolls including one or more upper work rolls disposed above one or more lower work rolls. An adjustable gap is present between the upper and lower work rolls of each work roll set, with the gap being equal from the entry side to the exit side thereof. A dual-stage leveler employs such a work roll assembly to remove shape defects from a moving strip material in the first stage and to remove coil set and/or curl from the strip material in the second stage, through a combination of work roll gap adjustment and first stage work roll bending. Because there is no feathering out of work roll penetration in either stage, differential roll speed and the problems associated therewith are eliminated.

21 Claims, 10 Drawing Sheets

(56) References Cited

U.S. PATENT DOCUMENTS

| | | | | |
|---|---|---|---|---|
| 4,698,990 | A | 10/1987 | Petri et al. | |
| 4,715,209 | A | 12/1987 | Oshima | |
| 4,726,213 | A | 2/1988 | Manchu | |
| 4,730,472 | A | 3/1988 | Ellis | |
| 4,881,392 | A | 11/1989 | Thompson et al. | |
| 5,069,054 | A | 12/1991 | Hladky | |
| 5,329,798 | A | 7/1994 | Takakura et al. | |
| 5,535,129 | A | 7/1996 | Keijser | |
| 5,560,237 | A | 10/1996 | Yasuda et al. | |
| 5,680,785 | A | 10/1997 | Quehen et al. | |
| 5,901,591 | A | 5/1999 | Kaplan | |
| 6,029,485 | A | 2/2000 | Bohmer | |
| 6,216,517 | B1 | 4/2001 | Hein | |
| 6,338,262 | B1 | 1/2002 | Donini et al. | |
| 6,769,279 | B1 | 8/2004 | Bergman et al. | |
| 6,993,947 | B2 * | 2/2006 | Tondo | B21D 1/02 72/164 |

OTHER PUBLICATIONS

Andritz Herr-Voss Stamco Inc., Enhanced Leveling Technology, http://www.herr-voss.com/enhanced-leveling-techology, 2017.

* cited by examiner

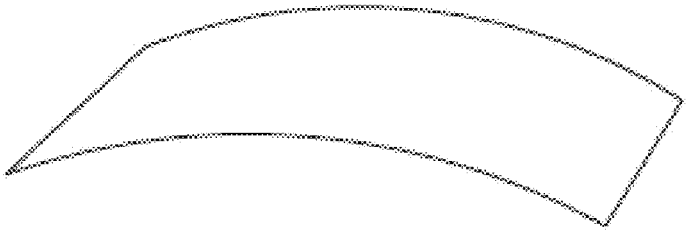
FIG. 1A
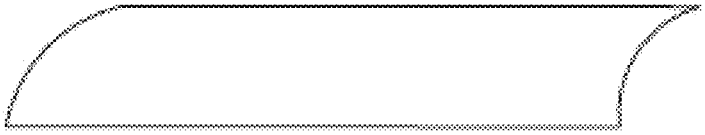
FIG. 1B
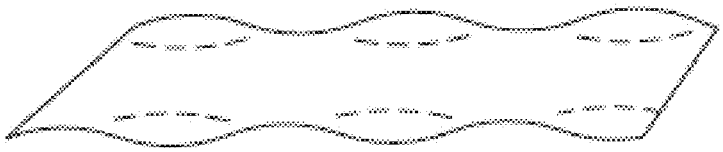
FIG. 1C
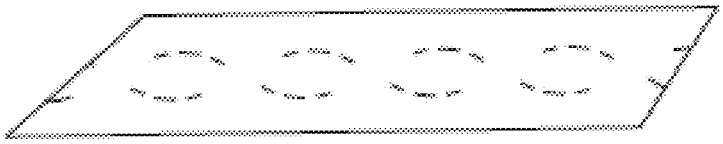
FIG. 1D
KNOWN ART
FIG. 1

KNOWN ART

KNOWN ART

KNOWN ART

KNOWN ART

KNOWN ART

KNOWN ART

DUAL-STAGE MULTI-ROLL LEVELER AND WORK ROLL ASSEMBLY

TECHNICAL FIELD

Embodiments of the application are directed to multi-roll shape-correction levelers and, more particularly, multi-roll shape-correction levelers designed to overcome problems associated with differential roll speed.

BACKGROUND

The basic concept of a multi-roll shape-correction leveler (hereinafter also "shape-correction leveler" or just "leveler" for brevity) has been known for many years. Shape-correction levelers were developed to account for the deficiencies of known hot rolling mills and the undesirable shape defects hot rolling mills commonly impart to the metal strip produced thereby. Common but non-limiting forms of such shape defects are shown in FIGS. 1A-1D, and include coil set, cross bow, edge wave, and center buckle, respectively.

As represented in FIG. 2, known shape-correction levelers typically use opposing, substantially parallel sets of multiple work rolls 5, 10 that often are supported by back-up rolls and associated bearings designed to withstand high separating forces and to control the bending and deflection of the work rolls. The work rolls are normally positioned so that an upper row of work rolls 5 are located above a cooperating lower row of work rolls 10. A gap 15 of adjustable dimension is normally present between the upper and lower work rolls 5, 10. A metal strip to be flattened is passed through the gap 15.

During a flattening operation, metal strip material (typically from a coil) is fed into the entrance of the leveler as indicated, whereafter it is caused to pass between the opposing sets of work rolls 5, 10 (see FIG. 2) before exiting from the exit side of the leveler. Each set of work rolls is placed into contact with the metal strip by driving one set of work rolls toward the other so that a leveling (flattening) force is impressed upon the metal strip as it passes therebetween.

In known levelers, the gap 15 between the upper work rolls 5 and lower work rolls 10 at the entry side of the leveler (and work rolls) is deliberately made to be different than the gap 15 at the exit side of the leveler (and work rolls). More specifically, the gap 15 at the entry side of the leveler is set to be less than the gap at the exit side of the leveler to provide more work roll penetration, and more working of the metal strip, nearer the entry side of the leveler. In other words, the gap distance, and the amount of work roll penetration, feathers out from the entry side to the exit side of the leveler (i.e., in the direction of material flow).

As shown in FIG. 4, contact between the upper and lower work rolls of a known leveler and a metal strip material being flattened, causes the metal strip to be repeatedly bent up and down (i.e., to S-wrap) as it passes through the work rolls located near the entry side of the associated leveler. This repeated bending of the metal strip material removes shape defects from the metal strip material that result from stresses induced therein by the hot rolling process. As can also be observed in FIG. 4, the amount of work roll penetration into the metal strip material, and the degree of resulting S-wrapping, decreases as the strip material moves toward the exit side of the leveler. The feathering out of work roll penetration from the entry side to the exit side of a leveler, allows shape defects to be removed by a first group of work rolls located nearer the entry side of the leveler and coil set to be removed by a second group of work rolls located nearer the exit side of the leveler. The number of work rolls involved in each operation may vary according to the total number of work rolls present and the degree of feathering (i.e., the difference between entry side and exit side gap) employed.

A shape-correction leveler may also be operated to selectively apply forces of different magnitudes to different areas of a strip of material passing therethrough. This selective application of force bends the work rolls to a shape that causes particular zones of the strip of material (from edge to edge) to be worked more than other zones as the strip passes through the leveler. Thus, shorter zones of the strip may be selectively elongated to match the length of the longer zones. This allows a shape-correction leveler to correct a variety of different shape defects.

For purposes of illustration, a typical shape-correction leveler setup 20 for correcting center buckle is shown in FIG. 3A, while a typical setup 25 for correcting edge wave is shown in FIG. 3B. The upwardly directed arrows in FIGS. 3A-3B represent upward work roll bending forces exerted at various locations along the length of the lower work rolls 30 of the leveler as needed to correct one or more shape defects. In the known leveler examples of FIGS. 3A-3B, the work roll bending forces are produced by pairs of driven adjusting wedges 35. In known levelers, such adjusting wedges operate to bend all of the lower and/or upper work rolls present. For example, in the case of the known leveler design shown in FIGS. 3A-3B, any bending forces produced by the adjusting wedges 35 would be applied to all of the lower work rolls 30.

Each work roll of a typical shape-correction leveler is normally driven to propel the strip of material through the leveler during a leveling (flattening) operation. A shape-correction leveler drive system commonly consists of a main motor, a reduction gearbox, and a pinion gearbox, that cooperate to provide output rotation to each work roll.

An interesting phenomenon occurs when the work rolls of known shape-correction levelers penetrate into a strip of material being processed and the material S-wraps through the work rolls. With light penetration (e.g., at the exit end of the leveler) the roll surface speed substantially matches the strip speed. However, when the rolls penetrate deeper (e.g., at the entry end of the leveler), the roll surface speed tends to run slower than the strip speed. This phenomenon occurs because the material has a bend radius, (entry end of leveler) and the surface speed of the material on the inside of the bend radius is moving slower than the surface speed on the outside of the bend radius (see FIG. 4). This is analogous to the wheel speed on an automobile, wherein the wheels on both sides of the automobile rotate at the same RPM when the automobile is going straight, but the wheels on the inside of the curve will rotate slower than the wheels on the outside of the curve when the automobile is making a turn. In the case of a shape-correction leveler, the work rolls are contacting the inside bending radius of the strip material, so the rolls on the entry end of the leveler run slower to match the slower inside radius surface speed. One example of this phenomenon, from an entry to an exit end of an exemplary leveler, is depicted in FIG. 5.

The aforementioned phenomenon may be referred to as differential roll speed (DRS). When the leveler work rolls are all driven together at the same speed (see e.g., FIG. 4 and FIG. 6), the entry rolls try to push the strip material through the exit rolls, while the exit rolls try to hold the material back. DRS causes several issues in a leveler. One issue is that when the work rolls are geared together, the DRS causes high loading on the entry work rolls and internal torque windup within the roll drive system—which may cause premature failure of the drive components. Another issue is that more power tends to be consumed when the work rolls are fighting each other. Yet another issue is that DRS tends to cause a compression of the strip material rather than a stretching of the material, which reduces the effectiveness of the leveler.

Various approaches to overcoming the effects of DRS have been attempted, including but not limited to, the use of torque limiters on drive shafts; the use of torque limiting clutches on entry work roll clusters; complex and costly work roll drive systems such as systems where each work roll is individually driven, and systems utilizing split entry and exit work roll clusters with individual drive motors; and the use of two separate levelers. While torque limiters have been placed on work roll drive shafts, it has proven difficult to produce a slip torque level that is high enough to actually process strip material on levelers so equipped. Torque limiters have also proven to have a short service life and have been unreliable. Placing a torque limiter on the entry work roll cluster of a leveler so as to control the torque to the entry cluster based on total load may be effective at reducing the internal torque windup typically resulting from DRS, but torque windup still occurs within each cluster and a high torque concentration may also be present at the split between the entry and exit roll clusters. Driving each work roll of a leveler individually is very costly and can result in control difficulties when an associated leveler is used to flatten strip material across a range of material and shape defect conditions. The use of split entry and exit roll drive clusters with individual motors can also be effective at reducing the internal torque windup normally resulting from DRS, but torque windup still occurs within each work roll cluster and a high torque concentration may also be present at the split between the entry and exit roll clusters.

The desirability of overcoming the negative effects of DRS should be apparent from the foregoing remarks. It should also be apparent that improvements over the techniques previously used to mitigate or eliminate the effects of DRS would also be desirable. Exemplary embodiments presented herein overcome the effects of DRS using a single, dual-stage leveler, that allows for a simplified work roll drive system.

SUMMARY

Exemplary dual-stage multi-roll leveler designs presented herein differ from known leveler designs at least because the work rolls of an exemplary dual-stage leveler are divided into two (or more) independent stages. Additionally, the entry side work roll gap and exit side work roll gap are kept equal, thereby eliminating the aforementioned feathering out of work roll penetration common to known levelers.

In one exemplary dual-stage leveler embodiment, the leveler includes a first work roll stage having a first set of work rolls that are subjected to roll bending for purposes of removing shape defects from strip material through material elongation as described above, as well as a separate, second work roll stage, that receives the strip material from the first stage and includes a second set of work rolls that are used to remove coil set and/or curl from the strip material without the use of work roll bending. The first stage work roll set and the second stage work roll set are independent of one another and may also be separately driven. As used herein, the terms "first stage" and "second stage" are intended to indicate only the order in which the provided sets of work rolls will contact the strip material as it passes through the leveler. No other meaning is to be implied.

The first stage work roll set and second stage work roll set may be—but do not have to be—installed to a cassette that is installable within the work envelope of the leveler. When used, the cassette may be divided into an upper half and a lower half, with the upper half including upper work rolls and associated supporting elements, and the lower half including lower work rolls and associated supporting elements.

An exemplary dual-stage leveler may include a gap adjusting mechanism, such as entry side and exit side jack screw assemblies, for adjusting the gap between (and the penetration of) the upper and lower work rolls of the first and second work roll sets. In at least some embodiments, the entry side and exit side jack screw assemblies may be geared together to always produce a uniform entry side-to-exit side work roll gap or change in work roll gap.

Work roll bending in an exemplary multi-stage leveler may be accomplished by various techniques known in the art. In one exemplary embodiment, an assembly of wedges may be used to produce desired work roll bending. A linear actuator or other motive device may be used to selectively displace the wedges as needed to produce the required work roll bending. In such an embodiment, first stage total work roll penetration may be controlled by a combination of jack screw assembly movement and wedge movement.

Other aspects and features of the inventive concept will become apparent to those skilled in the art upon review of the following detailed description of exemplary embodiments along with the accompanying drawing figures.

BRIEF DESCRIPTION OF THE DRAWINGS

In the following descriptions of the drawings and exemplary embodiments, like reference numerals across the several views refer to identical or equivalent features, and:

FIGS. 1A-1D illustrate several shape defects common to hot-rolled metal strip material;

DETAILED DESCRIPTION OF THE EXEMPLARY EMBODIMENTS

Figure 2:
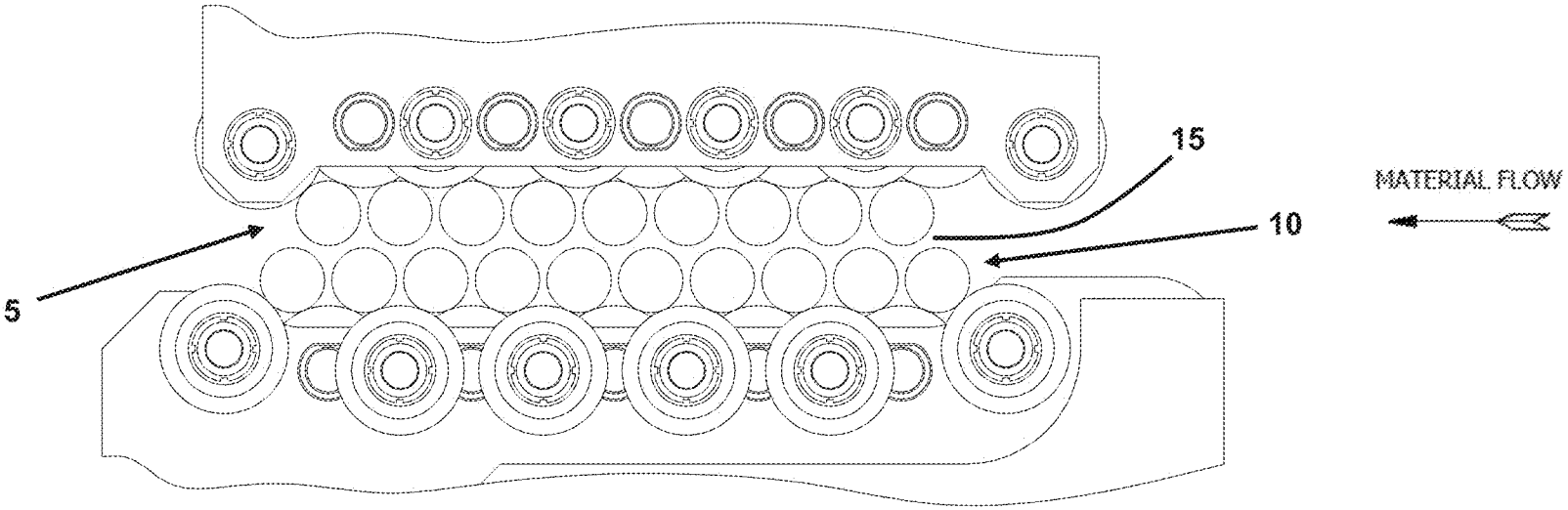
FIG. 2 depicts an exemplary upper and lower set of work rolls of a known shape-correction leveler design.
Figure 3A:
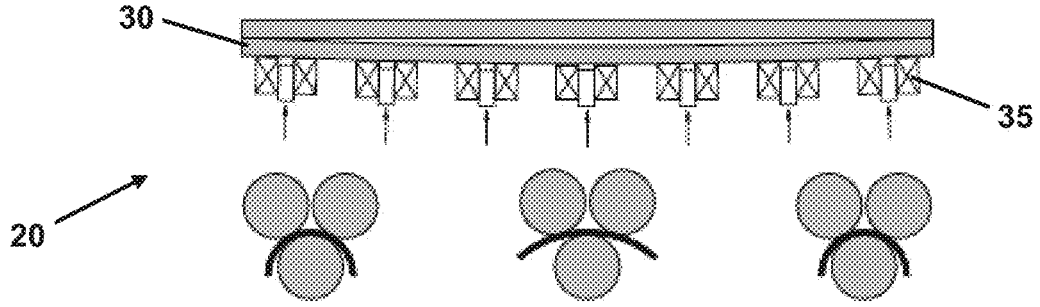
FIG. 3A depicts an exemplary technique for correcting a center buckle shape defect using a known shape-correction leveler.
Figure 3B:
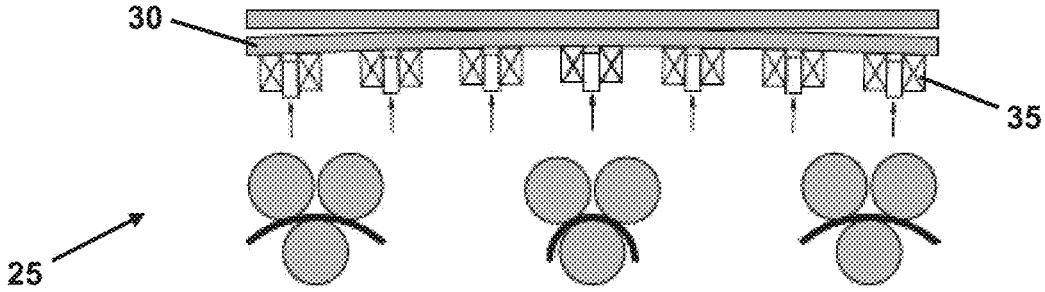
FIG. 3B depicts an exemplary technique for correcting an edge wave shape defect using a known shape-correction leveler.
Figure 4:
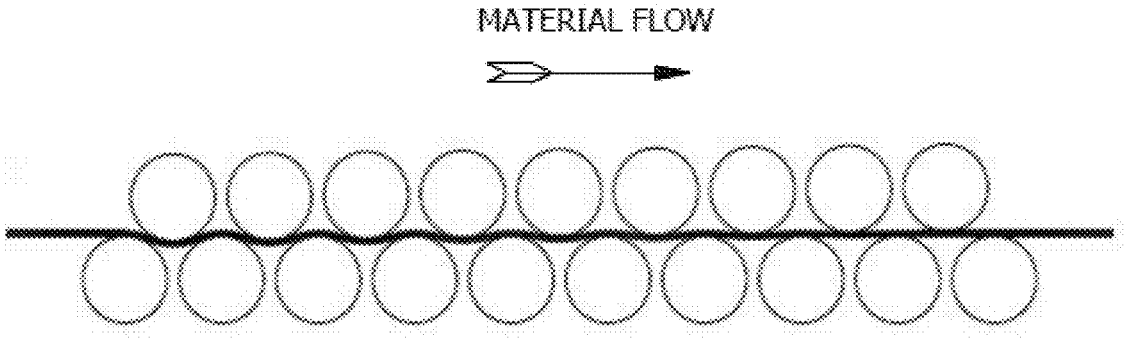
FIG. 4 and FIG. 5, in combination, help to illustrate the problem of differential roll speed on a known multi-roll shape-correction leveler.
Figure 5:
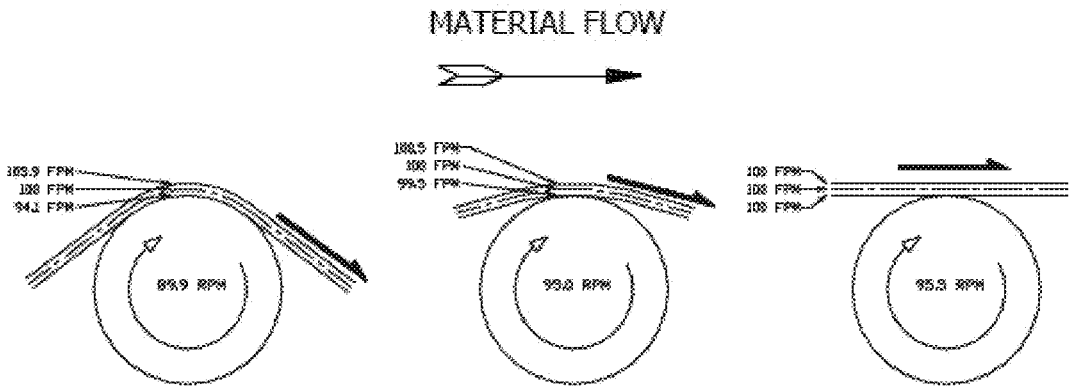
Figure 6:
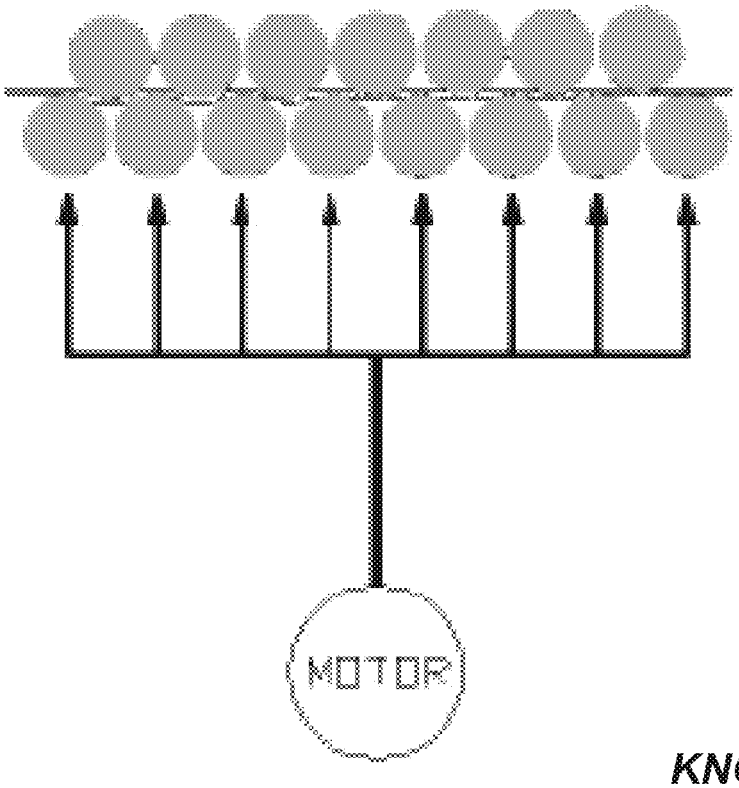
FIG. 6 represents a commonly used shape-correction leveler drive scheme where all of the leveler work rolls are driven at the same speed.

The aforementioned problem of differential roll speed on a multi-roll leveler of typical, known design, is illustrated via the combination of FIGS. 4-6. Particularly, when the rolls of a multi-roll shape-correction leveler are all driven together at the same speed (see FIG. 6) with a feathering out of work roll penetration (see FIG. 4), the entry rolls attempt to push the strip material being leveled through the exit rolls, while the exit rolls resist such movement.

Exemplary dual-stage multi-roll leveler (hereinafter "dual-stage leveler" for brevity) embodiments described herein are able to overcome the aforementioned problems associated with differential roll speed in a novel and efficient manner. A schematic side view of one such exemplary dual-stage leveler 100 appears in FIG. 7.

Figure 7:
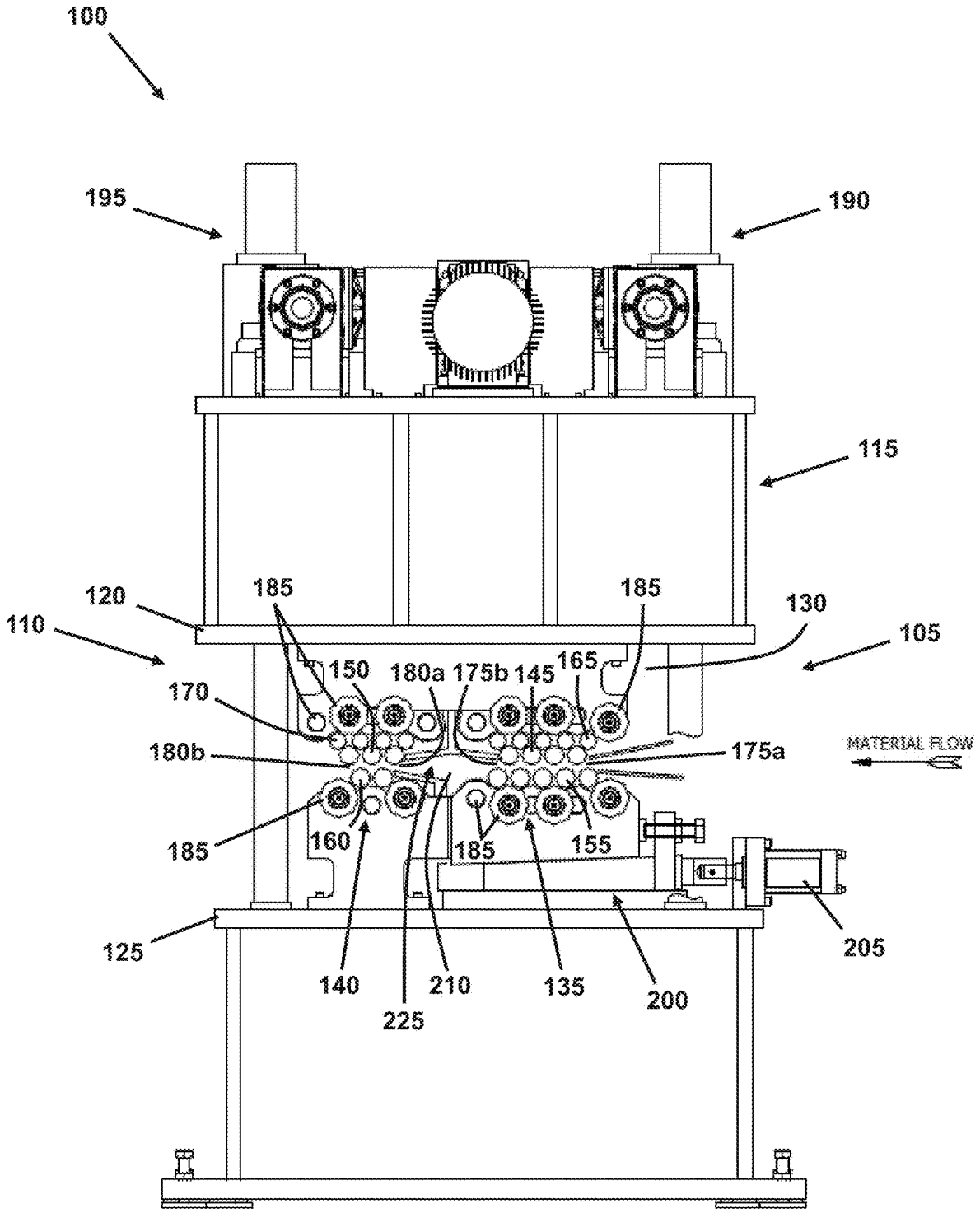
FIG. 7 is a side view of one exemplary embodiment of a dual-stage multi-roll leveler.

As shown in FIG. 7, the dual-stage leveler 100 has an entry side 105 and an exit side 110, with material flow occurring in an entry-to-exit direction as indicated by the arrow. Typically, and as would be familiar to one of skill in the art, strip material to be flattened is fed from a coil into the entry side 105 of the dual-stage leveler 100.

The exemplary dual-stage leveler 100 also includes a frame 115, with which is associated an upper and lower platen 120, 125. A working envelope 130 is defined between the platens 120, 125 and the entry side 105 and exit side 110 of the dual-stage leveler 100.

Disposed within the working envelope 130 is a first work roll stage 135 and a second work roll stage 140—the terms "first" and "second" being used herein only in a descriptive sense to indicate the order in which the work roll stages will encounter a strip material being passed through the leveler. Each of the first and second work roll stages 135, 140 includes work roll sets comprising a plurality of upper work rolls 145, 150 disposed above a plurality of lower work rolls 155, 160—the upper work rolls 145 and the lower work rolls 155 defining a first work roll stage work roll set and the upper work rolls 150 and the lower work rolls 160 defining a second work roll stage work roll set.

While the first work roll stage work roll set is shown to have a total of nine work rolls and the second work roll stage work roll set is shown to have a total of five work rolls in the dual-stage leveler 100 of FIG. 7, it is to be understood that different numbers of first stage work rolls and second stage work rolls may be utilized in other dual-stage leveler embodiments. Likewise, while the work rolls 145, 155 of the first work roll stage 135 and the work rolls 150, 160 of the second work roll stage 140 are shown to be the same diameter in the exemplary dual-stage leveler 100 of FIG. 7, it should be understood that in other dual-stage leveler embodiments the works rolls of one leveler stage and the work rolls of the other leveler stage(s) may have dissimilar diameters.

The upper work rolls 145, 150 and the lower work rolls 155, 160 of the exemplary dual-stage leveler 100 are arranged in a substantially parallel relationship between the entry side 105 and exit 110 side of the leveler, with the longitudinal axis of each work roll oriented substantially perpendicular to the direction of travel of the strip material that will be passed through the leveler. As described in more detail below, the upper work rolls 145 and the lower work rolls 155 of the first work roll stage work roll set will cooperate to remove strip material shape defects during leveler operation, while the upper work rolls 150 and the lower work rolls 160 of the second work roll stage work roll set will cooperate to remove coil set and/or induced curl from the strip material during leveler operation.

The upper work rolls 145, 150 and/or the lower work rolls 155, 160 of the first and/or second stage work roll sets may be supported by a corresponding set of backup rolls, such as the exemplary backup rolls 165, 170 shown to support the upper work rolls 145, 150 in FIG. 7. The backup rolls are disposed in flights, such that two backup rolls support each work roll. It may also be possible to eliminate the backup rolls in other embodiments.

The first and second leveler stages also include support bearings 185 that function to support the work rolls 145, 150, 155, 160—whether directly or through associated backup rolls. In the exemplary dual-stage leveler 100 of FIG. 7, the first stage work roll set includes six upper support bearings and six lower support bearings, while the second stage work roll set includes five upper support bearings and three lower support bearings. The number of bearings present in a given leveler embodiment will depend on the number of work rolls and/or backup rolls present and, therefore, the number of bearings used may be different in other leveler embodiments.

A gap adjusting mechanism is provided to adjust the space between the platens 120, 125 and, consequently, the gap between the upper work rolls 145, 150 and lower work rolls, 155, 160 of the first stage and second stage work roll sets. The gap between the upper work rolls 145, 150 and the lower work rolls 155, 160 of the first stage and second stage work roll sets is provided to allow metal strip material to pass therethrough during leveler operation.

In some embodiments, the gap adjusting mechanism of a dual-stage leveler embodiment may be configured for independent adjustment of the platen spacing along the entry and exit sides of the leveler. In other exemplary embodiments, the gap adjusting mechanism may be configured such that operation thereof will simultaneously adjust both the entry side and exit side platen spacing. In any case, the initial setting and subsequent adjustment of the platen spacing occurs in a manner that maintains parallelism between the platens and, consequently, an equal gap between the upper and lower work rolls of the first stage work roll set and the upper and lower work rolls of the second stage work roll set.

In the exemplary dual-stage leveler 100 of FIG. 7, the gap adjusting mechanism is comprised of pairs of vertically oriented entry side and exit side jack screw assemblies 190, 195. The entry side and exit side jack screw assemblies 190, 195 may be geared or otherwise connected or controlled so that parallelism between the platens 120, 125 and an equal gap between the upper and lower work rolls of the first stage and second stage work roll sets will be maintained during operation of the jack screw assemblies. As would also be familiar to one of skill in the art, one or more electric motors (or another type of motor) may be utilized to drive the jack screw assemblies 190, 195. It is also possible that the motor-driven jack screw assemblies 190, 195 may be replaced with hydraulic cylinders or other suitable actuating devices in other embodiments.

As should be understood from the foregoing description, the feathering out of work roll penetration common to known multi-roll levelers is eliminated in an exemplary dual-stage leveler design. Consequently, as shown in the exemplary dual-stage leveler 100 of FIG. 7, the entry gap **175*a* and exit gap 175*b* between the upper and lower work rolls 145, 150 of the first stage work roll set will be equal, as will the entry gap 180*a* and exit gap 180*b* between the upper and lower work rolls 150, 160** of the second stage work roll set.

As briefly mentioned above, shape defect removal is further accomplished in the first stage of a dual-stage leveler embodiment by way of bending the first work roll stage work rolls to selectively elongate or otherwise selectively deform at least certain sections of the strip material being flattened. Work roll bending may be performed on the upper work rolls and/or lower works rolls of a dual-stage leveler first work roll stage work roll set. In the exemplary dual-stage leveler 100 embodiment of FIG. 7, only the lower work rolls 155 of the first work roll stage work roll set are subject to such bending.

Work roll bending in an exemplary dual-stage leveler may be achieved by any one or more of several techniques. In the case of the exemplary dual-stage leveler 100 embodiment of FIG. 7, work roll bending is accomplished by way of an adjusting wedge assembly 200 that lies subjacent to the lower work rolls 155 of the first work roll stage work roll set. The adjusting wedge assembly 200 may be comprised of a plurality of individual adjusting wedges whose positions may be selectively adjusted by way of corresponding actuators 205 to impart the desired work roll bending. For example and without limitation, the adjusting wedge assembly 200 may be configured and may operate as represented in FIG. 7, such that all of the lower work rolls 155 of the first work roll set will be locally bent (i.e., work roll penetration will be adjusted) by a like amount during movement of a given wedge.

In previous multi-roll leveler designs, the upper crown or the wedge assembly of the leveler must tilt to provide deep entry roll penetration and little exit roll penetration—resulting in roll penetration that feathers out from the entry side to the exit side of the leveler as needed. However, this traditional leveler design and setup creates the differential roll speed and undesirable internal torque windup described above. In contrast, when an exemplary dual-stage leveler is configured as described above with respect to the dual-stage leveler 100 of FIG. 7, there is no tilting of the wedge assembly and no feathering out of work roll penetration, as is common with known multi-roll levelers.

In the exemplary dual-stage leveler 100 of FIG. 7, uniform penetration of the work rolls 145, 155 across the first work roll stage is produced by a combination of jack screw assembly and wedge assembly operation, while uniform penetration of the work rolls 150, 160 across the second work roll stage is produced by jack screw assembly operation only.

As a result of equal entry side and exit side work roll penetration within each leveler stage, as described above, the rotational speed of the entry and exit work rolls of each leveler stage will be the same (i.e., equal to the surface speed experienced by the inside bend radius of the strip material being processed). Differential roll speed is, therefore, eliminated by such a design, as is any associated internal torque windup within each stage. The lack of internal torque windup allows all of the torque applied to each work roll to be utilized for working the strip material, and the applied torque will be substantially equally distributed to each of the work rolls within a given stage (although the first and last work roll will may experience slightly less torque due to a lesser material wrap angle). Also, the lack of internal torque windup allows for a very predictable and manageable torque distribution.

Figure 8:
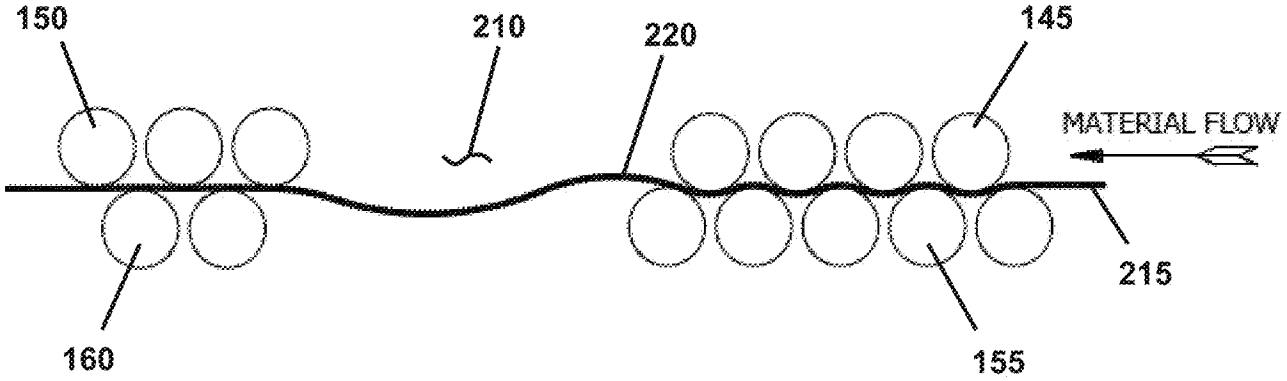
FIG. 8 is a schematic representation of the movement of a strip material through the work rolls of an exemplary dual-stage multi-roll leveler.

As can be further observed in FIG. 7, and as schematically indicated in FIG. 8, proper location of the support bearings 185 in the dual-stage leveler 100 results in a space 210 between the exit side of the first stage work roll set and the entry side of the second stage work roll set. Strip material exiting the work rolls of the first work roll stage must traverse this space 210 in order for the unrestrained leading end thereof to reach the work rolls of the second work roll stage. As indicated in FIG. 8, the strip material 215 may also be somewhat upwardly-directed in an area 220 near the first work roll stage work roll set as a result of an up-curl imparted by the work rolls 145, 155 thereof. Strip material may alternatively be somewhat downwardly-directed upon exiting the first work roll stage work roll set due to down-curl, in embodiments where the first work roll stage work rolls are arranged such that the most downstream work roll is an upper work roll (e.g., if the upper and lower work roll configurations 145, 155 are reversed). To help ensure proper initial engagement of the moving strip material 215 with the second stage work roll set, the exemplary dual-stage leveler 100 may include a guide 225, deflector assembly, threading plate, or some other mechanism for ensuring that the leading end of the strip material 215 is directed into the gap between the work rolls 150, 160 of the second work roll stage work roll set.

An even better understanding of the operation of the exemplary dual-stage leveler 100 may be gained by reference to FIG. 8, where it can be observed that when the strip material 215 is passed through the dual-stage leveler 100 in the indicated material flow direction, the work rolls 145, 155 of the first work roll stage work roll set will engage the strip material to remove shape defects from the strip material as explained above. That is, work roll penetration and bending in the first leveler stage are controlled and directed such that the strip material 215 is caused to wrap partially around at least some of the work rolls 145, 155 of the first work roll stage work roll set so as to elongate or otherwise deform at least certain areas of the strip material as necessary to remove shape defects present therein. Likewise, work roll penetration in the second leveler stage is simultaneously such that the work rolls 150, 160 of the second work roll stage work roll set will engage the strip material 215 in a manner by which any remaining coil set is removed from the strip material, as also explained above. The second work roll stage work roll set is also operative to remove any curl (see below) or other undesirable shape characteristics imparted to the strip material by the first work roll stage work roll set.

In some exemplary dual-stage leveler embodiments, such as the dual-stage leveler 100 shown in FIG. 7, the work rolls and position control hardware (e.g., wedges, actuators) may be built into the leveler. For example, the work rolls may be mounted in roll frames that are secured to the leveler platens in a manner that does not provide for easy removal, and the wedge actuators may be mounted to the leveler frame, etc., and may be mechanically coupled to the corresponding wedges for pushing or pulling movement thereof.

Figure 9:
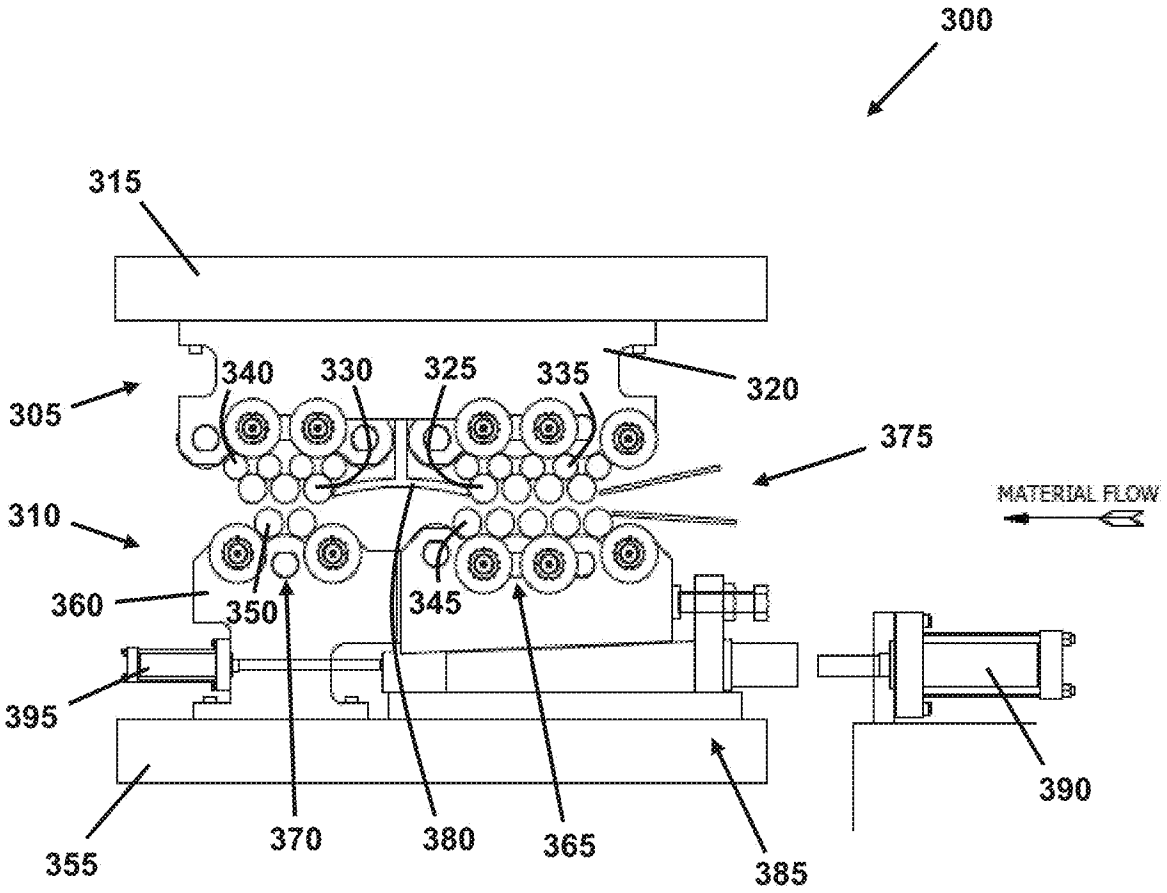
FIG. 9 is an exemplary work roll-containing cassette module that may be utilized in an exemplary dual-stage multi-roll leveler.

Alternatively, the work rolls of a dual-stage leveler embodiment may be provided as part of a removable cassette assembly. One such exemplary cassette assembly 300 is represented in FIG. 9. As shown, the exemplary cassette assembly 300 is divided into a removable upper and lower cassette subassembly 305, 310.

The upper cassette subassembly 305 includes an upper sub-platen 315 that is adapted for releasable affixation to the upper platen of an associated dual-stage leveler (e.g., to the upper leveler platen 120 in FIG. 7). An upper cassette work roll retention frame 320 is located subjacent to the upper sub-platen 315 and is adapted to retain upper work rolls 325, 330 of respective first stage and second stage work roll sets. The upper cassette work roll retention frame 320 may be further adapted for retention of first stage and second stage upper backup rolls 335, 340, bearings, and/or a variety of other work roll-related components.

In a similar manner to the upper cassette subassembly 305, the lower cassette subassembly 310 includes a lower sub-platen 355 that is adapted for releasable affixation to the lower platen of an associated dual-stage leveler (e.g., to the lower leveler platen 125 in FIG. 7). A lower cassette work roll retention frame 360 is located superjacent to the lower sub-platen 355 and is adapted to retain lower work rolls 345, 350 of respective first stage and second stage work roll sets. The lower cassette work roll retention frame 320 may be further adapted for retention of first stage and second stage lower backup rolls 365, 370, bearings, and/or a variety of other work roll-related components.

In the same manner as described with respect to the exemplary dual-stage leveler 100 of FIG. 7, the upper work rolls 325 and the lower work rolls 345 define a first work roll stage work roll set and the upper work rolls 330 and the lower work rolls 350 define a second, independent, work roll stage work roll set of the exemplary cassette assembly 300. The exemplary cassette assembly may include any of the other features associated with the first and second stage of the exemplary dual-stage leveler 100 of FIG. 7. For example, and without limitation, the cassette assembly 300 may include an infeed director 375, and a guide 380, deflector assembly, threading plate, or some other means for ensuring that the leading end of the strip material fed into the cassette assembly is directed into the gap between the work rolls 330, 350 of the second work roll stage work roll set.

The exemplary cassette assembly 300 may further include a wedge assembly 385 that, in this embodiment, is a part of the lower cassette subassembly 310. The wedge assembly 385 may include a plurality of individual and selectively movable wedges as previously described in regard to the aforementioned wedge assembly 200 of FIG. 7. In the case of this exemplary cassette assembly 300, however, a first set of actuators 390 is provided for moving the wedges in a penetration-increasing direction, and a second set of actuators 395 is provided for moving the wedges in a penetration-decreasing direction.

The dual-actuator design of this exemplary cassette embodiment allows the first set of actuators 390 to remain mechanically disconnected from the associated wedges, which facilitates installation and removal of the cassette assembly 300 to/from a dual-stage leveler. To further facilitate installation and removal of the cassette assembly in such an embodiment, the actuator stroke of the first set of actuators 390 may also be longer than the maximum wedge travel distance so as to allow for a gap between the pistons of the actuators 390 and a contacting surface of the wedges when the actuator pistons are withdrawn. The first set of actuators 390 may be mounted, for example, to a frame portion of an associated dual-stage leveler or to another structure in sufficiently close proximity thereto.

The second set of actuators 395 may be mounted to the lower cassette subassembly 310. As the actuators of the first set of actuators 390 are not mechanically connected to the wedges of the wedge assembly 385 in this exemplary cassette assembly 300, said actuators do not function to retract the wedges subsequent to making a penetration-increasing movement thereof. Instead, the second set of actuators 395 is utilized to move the wedges in a penetration-decreasing direction. The actuators of the second set of actuators 395 may or may not be mechanically connected to the wedges of the wedge assembly 385.

The cassette assembly 300 is mounted within a dual-stage leveler with the upper sub-platen 315 of the upper cassette subassembly 305 releasably affixed to the upper platen of the leveler, and the lower sub-platen 355 of the lower cassette subassembly 310 releasably affixed to the lower platen of the leveler. With the cassette assembly so installed to the remainder of a dual-stage leveler, flattening of metal strip material may proceed as described above with respect to FIG. 7 and FIG. 8.

In one exemplary technique for removal of the cassette assembly 300, the upper cassette subassembly 305 is first brought substantially into contact with the lower cassette subassembly 310. Thereafter, both subassembly platens 315, 355 may be detached from the leveler platens and the entire cassette assembly 300 may be rolled or otherwise removed from the associated leveler, such as by means of a moveable cart, etc.

Figure 10:
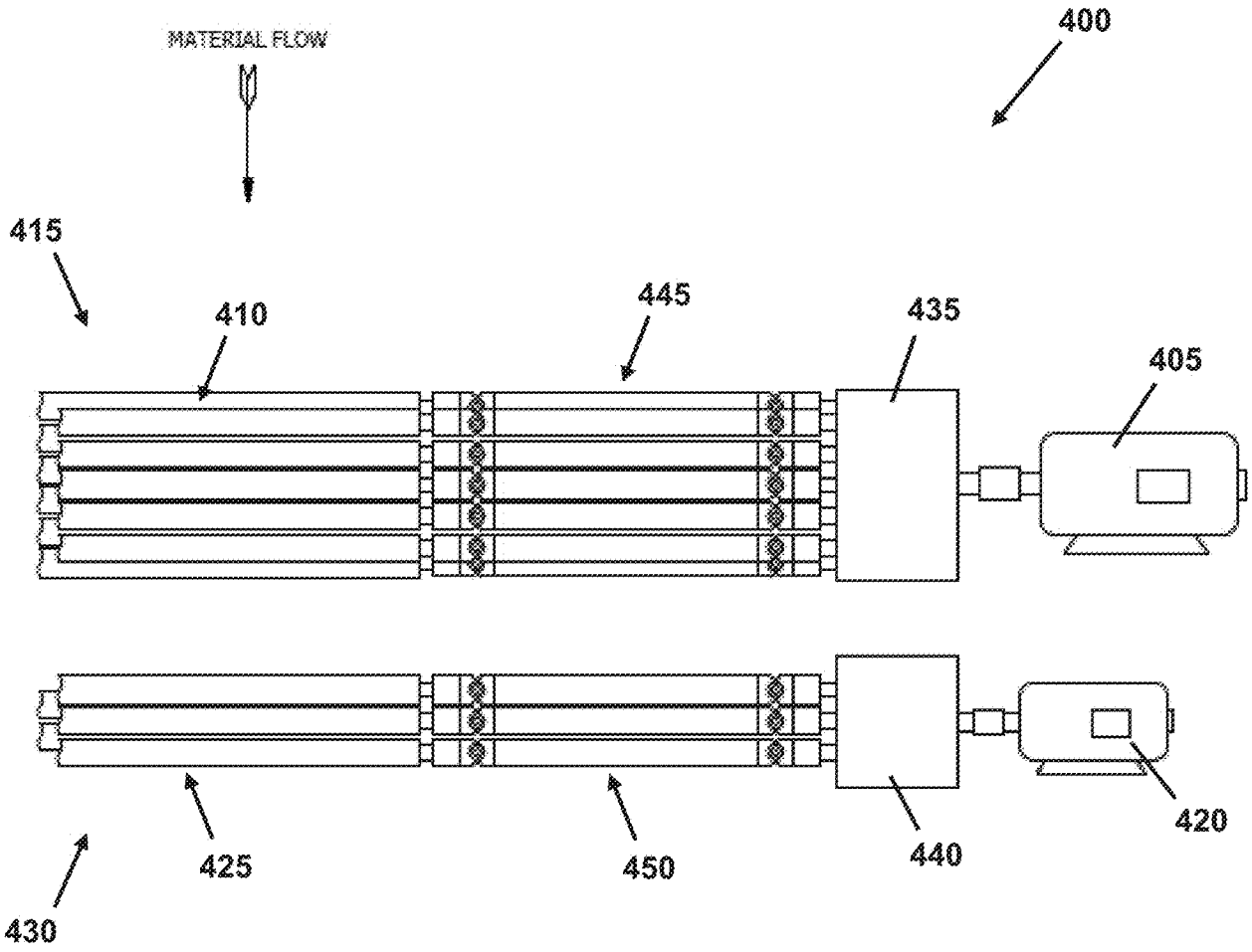
FIG. 10 depicts one exemplary drive scheme for a dual-stage multi-roll leveler.

A roll drive system is used to drive the work rolls of a dual-stage leveler, such as but not limited to, the exemplary dual-stage leveler shown in FIG. 7. One such exemplary drive system 400 is schematically depicted in FIG. 10. In this exemplary drive system 400, a first motor 405 is provided to drive the work rolls 410 of a first work roll set corresponding to a first stage 415 of an associated dual-stage leveler. Similarly, a second motor 420 is provided to drive the work rolls 425 of a second work roll set corresponding to a second stage 430 of the dual-stage leveler. The motors 405, 420 may be variable speed drive motors. In the exemplary drive system 400 of FIG. 10, the first motor 405 associated with the first leveler stage 415 acts as the master drive for the leveler. The second motor 420 (and second stage work rolls 425) may be operated at a different rotational speed than the first motor. For example, the second motor may be operated at a rotational speed that is slightly greater than the rotational speed of the first motor 405 (and first stage work rolls 410)—depending on the strip material being processed and first stage work roll penetration—to ensure that the second stage work roll set does not impede the forward motion of the strip material after it leaves the first stage work roll set.

As would be understood by one of skill in the art, the motors 405, 420 may be coupled to respective gearboxes, such as the multi-output pinion gearboxes 435, 440 shown. Output torque from the gearboxes 435, 440 may be transferred to the work rolls 410, 425 of the respective work roll sets by way of corresponding sets of couplings 445, 450. In this exemplary embodiment, the couplings 445, 450 are flexible in nature to accommodate adjustments in work roll penetration and bending.

Figure 11:
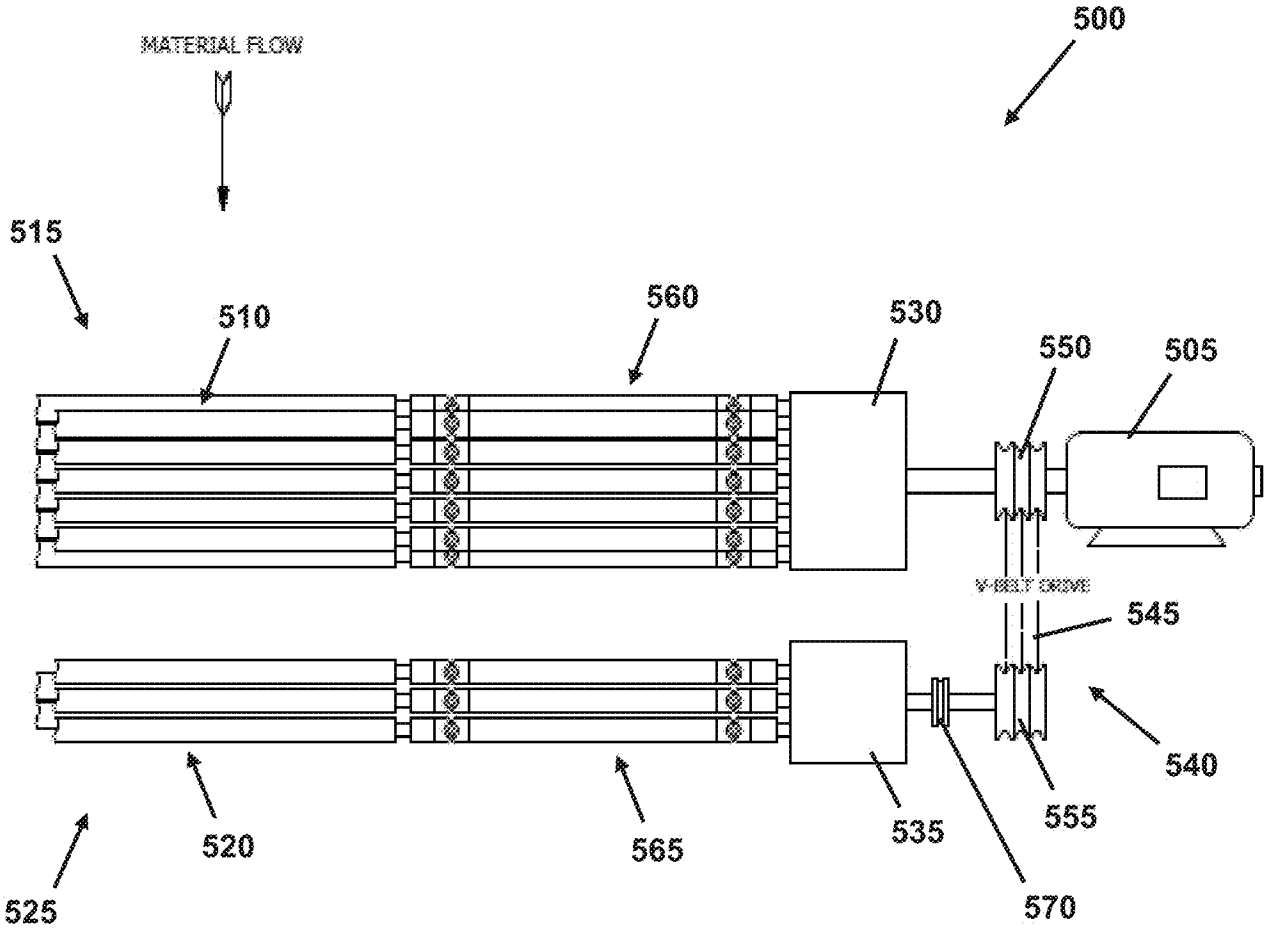
FIG. 11 depicts an alternative exemplary drive scheme for a dual-stage multi-roll leveler.

Another exemplary roll drive system 500 is schematically depicted in FIG. 11. In this exemplary drive system 500, a single motor 505 is provided to drive the work rolls 510 of a first work roll set corresponding to a first stage 515 of an associated dual-stage leveler, as well as the work rolls 520 of a second work roll set corresponding to a second stage 525 of the dual-stage leveler. The motor 505 may again be a variable speed drive motor.

The motor 505 is coupled to respective first stage and second stage gearboxes, such as the multi-output pinion gearboxes 530, 535 shown. In this exemplary drive embodiment, coupling of the motor 505 to the gearboxes 530, 535 is accomplished by way of a belt drive assembly 540 that includes a drive belt 545, first belt pulley 550 coupled to the motor output, and a second belt pulley 555 coupled to the input of the second stage gearbox 535.

It may again be desirable to operate the second stage work rolls 520 at a rotational speed that is slightly greater than the rotational speed of the first stage work rolls 510 (as explained above). Consequently, the first belt pulley 550 and the second belt pulley 555 of the belt drive assembly 540 may have dissimilar diameters to provide for such a difference in work roll rotational speed.

As in the roll drive system 400 of FIG. 10, output torque from the gearboxes 530, 535 of this exemplary roll drive system 500 may be transferred to the work rolls 510, 520 of the respective work roll sets by way of corresponding sets of couplings 560, 565. In this exemplary embodiment, the couplings 560, 565 are again flexible in nature to accommodate adjustments in work roll penetration and bending. A torque-limiting clutch 570 or other suitable protective element may also be provided to limit the amount of torque applied to the second stage work roll set.

It is to be understood that the roll drive systems 400, 500 of FIGS. 10-11, respectively, have been shown and described herein only for purposes of illustration. Other roll drive designs may also be used in other exemplary dual-stage leveler embodiments. For example, and without limitation, any of the various roll drive systems shown in FIGS. 7-11 of U.S. patent application Ser. No. 15/076,503 filed on Mar. 21, 2016, may be used to drive the work rolls of an exemplary dual-stage leveler.

Dual-stage leveler embodiments, such as those described and shown herein, overcome the problems of differential roll speed and resulting internal torque windup that are inherent to known multi-roll leveler designs. Such dual-stage leveler embodiments may also produce other benefits. For example, because all of the work rolls in the first stage of an exemplary dual-stage leveler will be subjected to equal penetration and bending, a larger differential (bending/flattening) path can be achieved with fewer work rolls. Thus, it may be possible to achieve a differential path through a dual-stage leveler with fewer work rolls than would be required to achieve a comparable differential path through a traditional multi-roll leveler. Further, since the problems associated with differential roll speed are eliminated by an exemplary dual-stage leveler, it may be possible to plunge (penetrate) the work rolls of the first leveler stage deeper into the strip material being processed, which should correspondingly produce a greater percent yield of the material with less torque required from the roll drive system.

While certain embodiments of the invention are described in detail above, the scope of the invention is not considered limited by such disclosure, and modifications are possible without departing from the spirit of the invention as evidenced by the following claims:

What is claimed is:

1. A dual-stage multi-roll leveler for flattening a moving strip material, comprising:

a framework defining a work envelope having a material entry side and a material exit side;

a driven first stage work roll set disposed within the work envelope and located to receive the strip material through the entry side thereof, the first stage work roll set including an entry side and an exit side and a plurality of upper work rolls disposed above a plurality of lower work rolls with a gap therebetween, where the gap between the upper and lower works rolls at the entry side is always equal to the gap between the upper and lower works rolls at the exit side;

a driven second stage work roll set disposed within the work envelope and located to receive the strip material from the first stage work roll set, the second stage work roll set being independent from the first stage work roll set and including an entry side and an exit side and a plurality of upper work rolls disposed above a plurality of lower work rolls with a gap therebetween, where the gap between the upper and lower works rolls at the entry side is always equal to the gap between the upper and lower works rolls at the exit side; and a work roll bending mechanism configured to selectively bend the upper work rolls or the lower work rolls of the first stage work roll set;

wherein the equal gaps at the entry side and exit side of each of the first stage work roll set and the second stage work roll set prohibit any feathering out of work roll penetration and eliminate any possible torque windup due to differential roll speed.

2. The leveler of claim 1, wherein the first stage work roll set is operative to remove shape defects from the strip material, and the second stage work roll set is operative to remove coil set from the strip material.

3. The leveler of claim 1, further comprising a leveler gap adjusting mechanism in the form of a plurality of powered jack screw assemblies.

4. The leveler of claim 3, wherein the plurality of powered jack screw assemblies are coupled together for concurrent and equivalent movement.

5. The leveler of claim 1, wherein the work roll bending mechanism is an adjustable wedge assembly.

6. The leveler of claim 5, wherein the adjustable wedge assembly includes:

a plurality of individually displaceable wedges, the wedges configured to act on each upper work roll or each lower work roll to the same degree; and a plurality of actuators for selectively and controllably displacing the wedges.

7. The leveler of claim 1, further comprising a material guide disposed between the first stage work roll set and the second stage work roll set, the material guide adapted to direct strip material exiting the first stage work roll set into the second stage work roll set.

8. The leveler of claim 1, further comprising a drive system for rotationally driving the at least one upper work roll and/or the at least one lower work roll of the first stage work roll set and the second stage work roll set.

9. The leveler of claim 8, wherein the drive system includes a first drive motor that is coupled to the at least one driven work roll of the first stage work roll set, and a second drive motor that is coupled to the at least one driven work roll of the second stage work roll set.

10. The leveler of claim 8, wherein the drive system includes a single drive motor that is coupled to both the at least one driven work roll of the first stage work roll set and the at least one driven work roll of the second stage work roll set, in a manner that allows the at least one driven work roll of each stage to be driven at different speeds.

11. The leveler of claim 10, wherein the drive system includes a drive belt assembly that employs a drive belt rotating first stage and second stage pulleys of dissimilar diameter, such that the at least one driven roll of the second stage work roll set will rotate at a greater speed than the at least one driven roll of the first stage work roll set.

12. A dual-stage multi-roll leveler for flattening a moving strip material, comprising:

a framework having an upper platen, a lower platen that is substantially parallel to the upper platen, an entry side and an exit side;

a work envelope defined between the upper platen and the lower platen and the material entry side and material exit side of the framework;

a first stage work roll set located within the work envelope to receive the strip material through the entry side of the work envelope, and including a plurality of upper work rolls associated with the upper platen and disposed above a plurality of lower work rolls associated with the lower platen with an adjustable gap between said upper and lower work rolls, the configuration of the first stage work roll set being such that the adjustable gap at an entry side thereof and the adjustable gap at an exit side thereof are always equal;

an independent second stage work roll set disposed within the work envelope and located to receive the strip material from the exit side of the first stage work roll set, the second stage work roll set including a plurality of upper work rolls associated with the lower platen and disposed above a plurality of lower work rolls associated with the lower platen with an adjustable gap between said upper and lower work rolls, the configuration of the second stage work roll set being such that the adjustable gap at an entry side thereof and the adjustable gap at an exit side thereof are always equal;

a gap adjusting mechanism configured to uniformly adjust the gap between the upper and lower platens;

a work roll bending mechanism configured to substantially uniformly bend all of the upper work rolls or all of the lower work rolls of the first stage work roll set; and a drive system configured to rotationally drive the upper work rolls and/or the lower work rolls of the first stage work roll set and the second stage work roll set;

wherein the first stage work roll set and the second stage work roll set are operable to independently but cooperatively remove shape defects from the moving strip material as the strip material passes through the leveler in a first stage-to-second stage direction with no feathering out of work roll penetration in either work roll stage nor any internal torque windup resulting from differential roll speed.

13. The leveler of claim 12, wherein the first stage work roll set is operative to remove shape defects from the strip material, and the second stage work roll set is operative to remove coil set from the strip material.

14. The leveler of claim 12, wherein the gap adjusting mechanism is a plurality of powered jack screw assemblies.

15. The leveler of claim 12, wherein the work roll bending mechanism is an adjustable wedge assembly comprising a plurality of individually displaceable wedges and a plurality of corresponding actuators for selectively and controllably displacing the wedges.

16. The leveler of claim 12, wherein work roll penetration of the first stage work roll set is adjustable using a combination of the gap adjusting mechanism and the work roll bending mechanism, while work roll penetration of the second stage work roll set is adjustable using only the gap adjusting mechanism.

17. The leveler of claim 12, further comprising a material guide disposed between the first stage work roll set and the second stage work roll set, the material guide adapted to direct strip material exiting the first stage work roll set into the second stage work roll set.

18. The leveler of claim 12, wherein the drive system includes a first drive motor that is coupled to the driven rolls of the first stage work roll set, and a second drive motor that is coupled to the driven rolls of the second stage work roll set.

19. The leveler of claim 12, wherein the drive system includes a single drive motor that is coupled to the driven rolls of both the first stage work roll set and the second stage work roll set in a manner that allows the driven work rolls of each stage to be driven at different speeds.

20. The leveler of claim 19, wherein the drive system includes a drive belt assembly that employs a drive belt rotating first stage and second stage pulleys of dissimilar diameter, such that the driven work rolls of the second stage work roll set will rotate at a greater speed than the driven work rolls of the first stage work roll set.

21. A dual-stage work roll assembly for use in a single multi-roll leveler, comprising:

a driven first stage flattening unit having an entry side and an exit side and including an upper work roll set disposed above a lower work roll set;

an independent and driven second stage flattening unit having an entry side and an exit side and including an upper work roll set disposed above a lower work roll set;

the first stage flattening unit and the second stage flattening unit arranged such that the entry side of the second stage flattening unit faces the exit side of the first stage flattening unit;

an adjustable gap between the upper and lower work roll sets of the first stage flattening unit, the first stage flattening unit constrained such that the adjustable gap at the entry side thereof and the adjustable gap at the exit side thereof are always equal;

an adjustable gap between the upper and lower work roll sets of the second stage flattening unit, the second stage flattening unit constrained such that the adjustable gap at the entry-side thereof and the adjustable gap at the exit side thereof are always equal; and a work roll bending mechanism for substantially uniformly bending all work rolls of the upper work roll set or all work rolls of the lower work roll set of the first stage flattening unit;

wherein, the first stage flattening unit and the second stage flattening unit are operative to independently flatten a moving strip material that is passed therethrough without any resulting internal torque windup due to differential roll speed.

* * * * *